US005813260A

United States Patent [19]

Widén

[11] Patent Number: 5,813,260

[45] Date of Patent: Sep. 29, 1998

[54] REMOVABLE CORE CYLINDER LOCK

[75] Inventor: Bo Widén, Torshälla, Sweden

[73] Assignee: Winloc AG, Zug, Sweden

[21] Appl. No.: 883,428

[22] Filed: Jun. 26, 1997

Related U.S. Application Data

[63] Continuation of Ser. No. 501,864, Jul. 13, 1995, abandoned.

[30] Foreign Application Priority Data

May 18, 1995 [SE] Sweden ..... 9501856

[51] Int. Cl.[6] ..... E05B 27/00

[52] U.S. Cl. ..... 70/369; 70/493; 70/371

[58] Field of Search ..... 70/367–371, 373–375, 70/492, 493, 340

[56] References Cited

U.S. PATENT DOCUMENTS

| | | | |
|---|---|---|---|
| Re. 31,910 | 6/1985 | Oliver | 70/369 |
| 1,656,854 | 1/1928 | Best | 70/369 |
| 3,298,211 | 1/1967 | Russell et al. | 70/369 |
| 3,667,264 | 6/1972 | Surko, Jr. et al. | 70/369 |
| 4,328,690 | 5/1982 | Ouver | 70/369 |
| 4,386,510 | 6/1983 | Best et al. | 70/369 |

*Primary Examiner*—Suzanne Dino Barrett

*Attorney, Agent, or Firm*—Birch, Stewart, Kolasch & Birch, LLP

[57] ABSTRACT

A removable core cylinder lock includes a cylinder lock casing and a removable cylinder lock core inserted into the casing. The lock core has an upper massive part with a row of holes for accommodating locking tumblers, and a lower part defining a cylindrical bore in which a cylindrical, rotatable key plug is located. The lower part defining the cylinder bore of the cylinder lock core is partially cut away so as to form an axially elongated chamber accommodating a transversely movable retainer member and leaving a continuous lower wall portion. The retainer member has an axial length, which corresponds to at least half of the axial length of the row of holes in the upper massive part, and a limited circumferential extension, which is substantially supplementary to the continuous lower wall portion so as to define the cylindrical bore.

20 Claims, 5 Drawing Sheets

REMOVABLE CORE CYLINDER LOCK

This application is a continuation of application Ser. No. 08/501,864 filed on Jul. 13, 1995, now abandoned.

BACKGROUND OF THE INVENTION

1. Field of the Invention

The present invention relates to a removable core cylinder lock, comprising a cylinder lock casing having an axially extending cavity, a removable cylinder lock core which is axially insertable into said cavity, said lock core having an upper massive part with a row of holes for accommodating locking tumblers and a lower part defining a cylindrical bore extending axially therethrough, a cylindrical, rotatable key plug located in said cylindrical bore and having a longitudinal key slot for receiving a key co-operating with said locking tumblers, a retainer member being transversely movable between a first position, in which it positively locks said lock core in its axially inserted position, and a second position, in which said lock core may be retracted, said retainer member having a transversely extending locking lug engaging with said casing when said retainer member is in said first position.

2. Description of the Background Art

Such a cylinder lock with a removable core is previously known from U.S. Pat. No. 4,328,690 and the corresponding re-issued patent No. RE.31910 (Medeco Security Locks Inc.). High security is obtained by way of a side or latch bar, being movable between a releasing position within a groove in the cylindrical outer surface of the rotatable key plug and a locking position engaging a recess adjoining the cylindrical bore of the lock core. Normally, the side bar is situated in its locking position, whereby the rotatable key plug as well as the retainer member are prevented from moving. Only when all six locking tumblers are elevated and twisted into specific elevational and rotational positions, will the locking tumblers be positioned with their end surfaces at the shear line defined by the outer cylindrical surface of the key plug and twisted into such rotational positions that the side bar is allowed to enter with its projections into vertical grooves in the tumblers, so that the side bar may be urged into its releasing position and the key plug may be rotated by means of a proper operating key inserted into the key slot of the key plug. During such normal operation, the retainer member will be held in place in its first position, where it positively locks the lock core axially in the cavity of the cylinder lock casing. The retainer member is formed as a ring or a sleeve, which encloses the rotatable key plug circumferentially all around, and is provided with a number of holes in registry with some of the holes accommodating the upper portions of the locking tumblers. The latter will be positioned partly in a hole in the lock core and partly in a corresponding hole in the retainer sleeve.

Moreover, the retainer sleeve constitutes a movable mid-section of the lower part of the lock core defining a cylindrical bore extending axially therethrough. It is provided with an axially extending recess at its inner, cylindrical surface, said recess being aligned with corresponding, axially or longitudinally extending recess portions in the inner cylindrical surface of the lower part of the lock core. When the removable cylinder lock core is to be taken out from the cylinder lock casing, one uses a special control key, by means of which the locking tumblers are elevated into positions with their end surfaces being located in a shear line between the retainer sleeve and the upper massive part of the lock core. Furthermore, to enable rotation of the retainer sleeve, all of the six tumblers have to be twisted into positions allowing the side bar to be moved sideways into its groove in the outer surface of the rotatable key plug. Otherwise, the side bar will be retained in its locking position, where it engages with the axial recess of the retainer sleeve and prevents the key plug and the retainer sleeve from being rotated.

Although the prior art lock provides high security, there are some disadvantages involved in its structure. In particular, the cylindrical bore is axially divided by the retainer sleeve which forms a movable mid-section located between two stationary end sections of the lock core. Therefore, it is difficult to obtain a well-defined, exact guidance of the rotatable key plug and to maintain structural strength and wear resistance. Moreover, the retainer sleeve will only be held in place by a few (normally two) locking tumblers, which prevent rotation of the retainer sleeve, during normal operation of the lock (turning of the key plug with a proper key). Furthermore, the division of the longitudinal recess for the side or latch bar into two end portions situated in the lower part of the lock core and a mid portion situated at the inside of the retainer sleeve may present problems of proper alignment, and such a divided longitudinal recess does not provide as good and exact a support for the side bar in its locking position as a longitudinal recess formed in a unitary wall portion.

SUMMARY OF THE INVENTION

Against this background, the primary object of the present invention is to provide an improved removable core cylinder lock of the general kind indicated in the opening paragraph, where the key plug is more exactly guided in the cylindrical bore in the lock core, and the retainer member is securely held in place, to prevent rotation thereof, by the locking tumblers during normal operation of the lock. At the same time, the structure should be sturdy and wear resistant, with relatively thick walls of the lock core and the retainer member, and the manufacture and assembly of the various parts should be simple and inexpensive. Furthermore, the lock should enable use in a lock system having a great number of variation possibilities for the control keys.

A secondary object of the invention is to achieve a structure, including a side bar, where the side bar is better and more accurately supported in its locking position at the inside of the lock core.

The primary object is achieved for a removable core cylinder lock of the present invention, wherein the lower part defining the cylinder bore of the cylinder lock core is partially cut away so as to form a chamber accommodating said transversely movable retainer member and leaving a continuous lower wall portion, which partially encloses the rotatable key plug and extends axially along substantially the whole length of said cylindrical bore, and wherein the retainer member has an axial length, which preferably corresponds to at least half of the axial length of said row of holes in said upper massive part, and a limited circumferential extension which is substantially supplementary to said continuous lower wall so as to define said cylindrical bore.

Thus, the retainer member is not formed as a sleeve which encloses the key plug all around. Rather, the chamber accommodating the retaining member and the retaining member itself have a limited circumferential extension, such as about 180° . The remaining, continuous lower wall portion of the removable cylinder lock core is dimensioned so as to partially enclose the key plug and support the latter along substantially the whole length thereof.

The axial length of the retainer member enables at least half of the tumblers in the row to lock the retainer member in its first position where it positively locks the lock core in the casing. Normally, three or four tumblers (of a total of six in the row) participate in this locking action.

The various parts are easy to manufacture, and the total structure is sturdy and strong.

Moreover, because of the number of tumblers participating in the locking engagement of the retainer member, typically three or four such tumblers, the number of variation possibilities for the control keys is relatively large.

When the key plug includes a side bar, the latter may cooperate directly with the locking tumblers in the central row of holes in the key plug, or it may cooperate with separate side tumblers accommodated in associated cavities formed in the key plug at one or both sides of the key slot.

In a preferred embodiment, the retainer member comprises a base portion, which is formed substantially as a part-cylindrical shell with external and internal cylindrical surfaces, and a radially outwardly projecting portion constituting the locking lug.

In principle, the retainer member may be displaceable by a translatory motion sideways between first and second positions However, preferably, the retainer member is rotatable between the first and second positions, an upper convex cylindrical surface being in sliding contact with a concave cylindrical surface at the upper, massive part of the lock core. Then, the retainer member may be moved into its second position, in which the lock core may be retracted, by means of a control key cooperating with tumbler portions partially situated in holes in the retainer member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Further advantageous features are stated in claims 7 through 14.

The invention will be explained more fully below with reference to the accompanying drawings illustrating a preferred embodiment.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BRIEF DESCRIPTION OF THE PREFERRED EMBODIMENT

Figure 1:
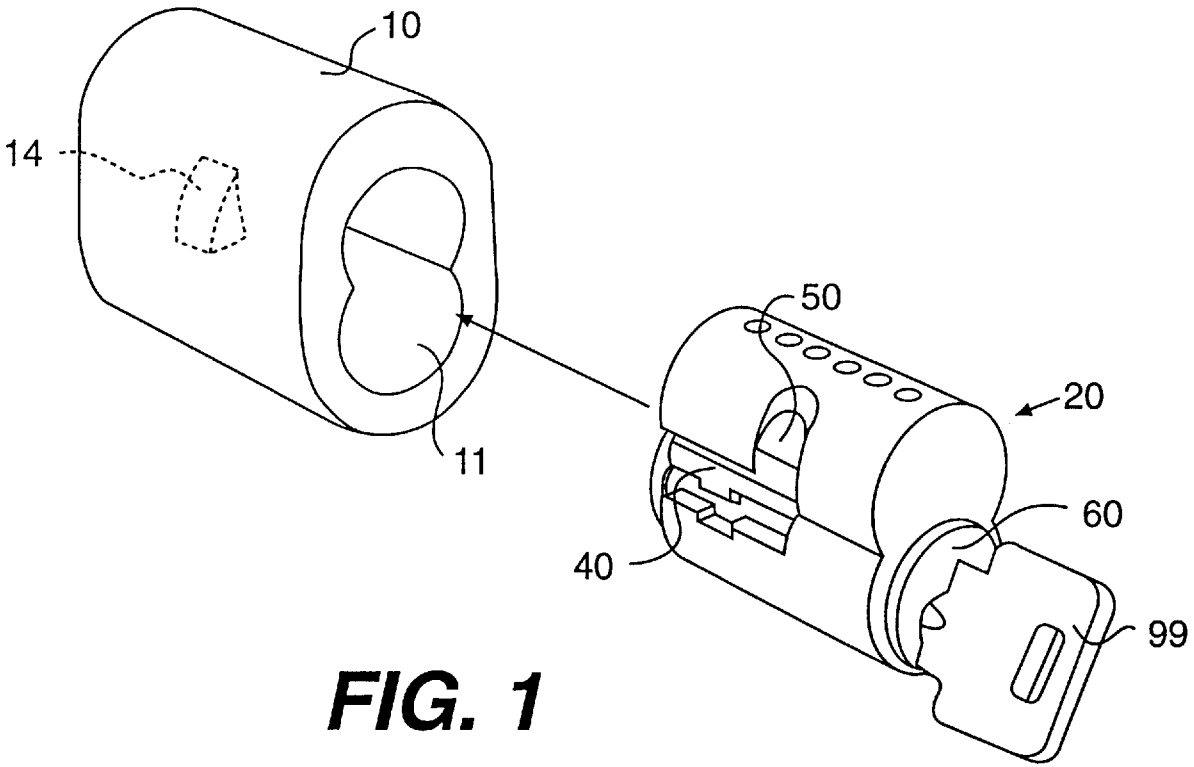
FIG. 1 shows in perspective view a cylinder lock casing and a removable cylinder lock core to be inserted into the casing.

In FIG. 1, there is shown a conventional cylinder lock casing 10 having an axially extending cavity 11 for receiving a removable cylinder lock core 20 with a rotatable key plug 60 and a key 99. The casing 10 is intended to be permanently mounted in a door (not shown) or some other object to be locked in relation to a frame or some other stationary structure. Alternatively, the casing 10 may constitute a padlock or some other locking device. The removable cylinder lock core 20 is axially insertable into the cavity 11 of the casing 10 and is retained in the casing by means of a retainer member 40 to be described further below. Upon insertion of the lock core 20 into the casing 10, the rear end of the key plug 60 cooperates, e.g. by way of an axially projecting member (not shown), with a secondary locking mechanism of any kind.

In the illustrated embodiment, the cavity 11 has a cross-sectional shape substantially like an "8" corresponding to the cross-sectional shape of the lock core 20, so that the latter fits slideably in the cavity 11. The inside bore defining the cavity 11 has a recessed portion 14 (indicated by dashed lines in FIG. 1) with which a transversely extending locking lug 50 of the retainer member engages so as to retain the lock core 20 in its inserted position.

Figure 2:
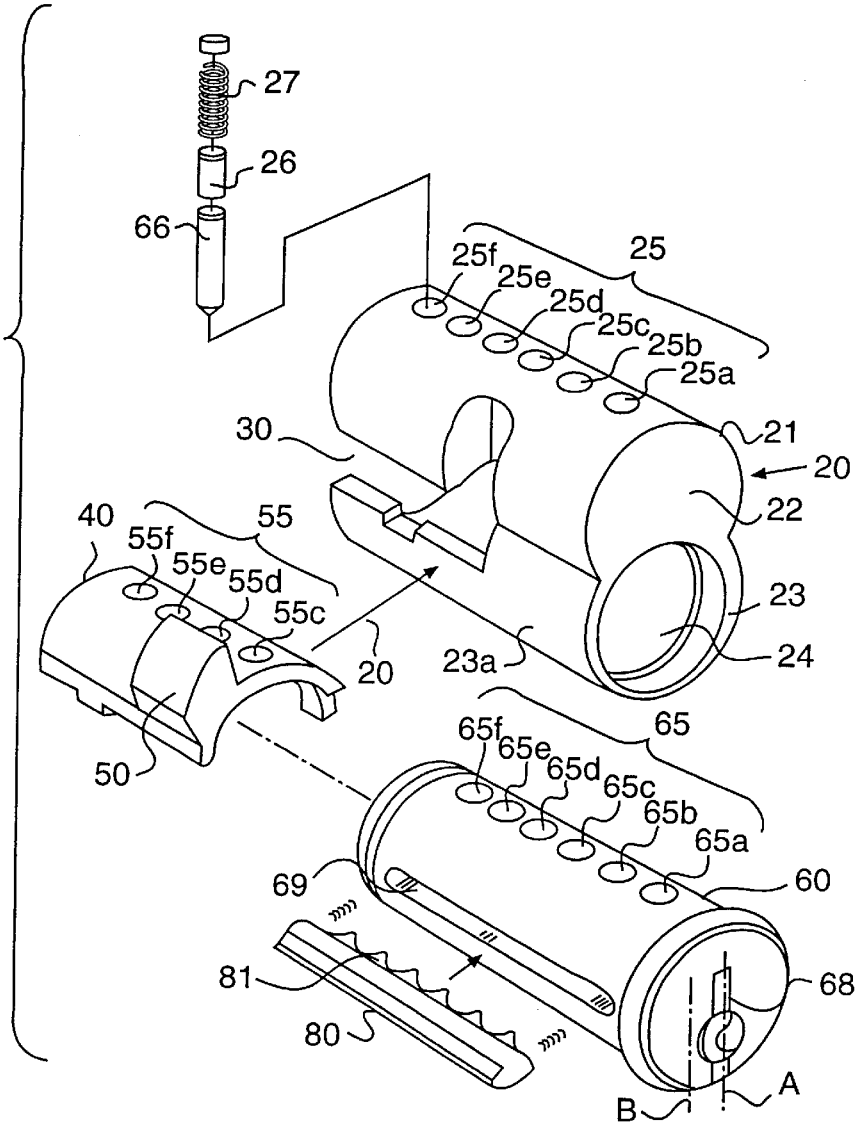
FIG. 2 illustrates, likewise in a perspective view, the basic parts of the removable cylinder lock core shown in FIG. 1, these parts being separated from one another for increased clarity.
Figure 4:
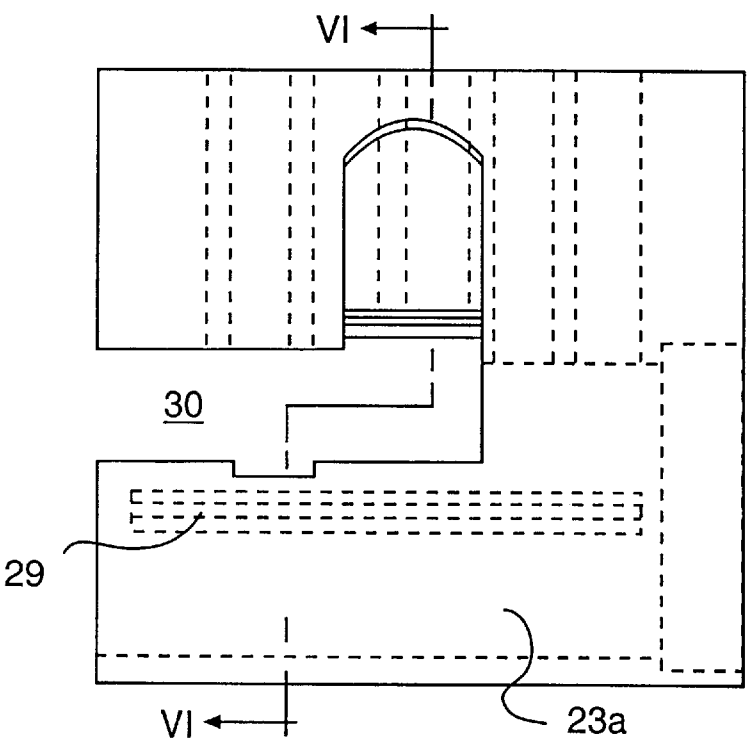
FIG. 4 is an opposite side view of the core body.
Figure 3:
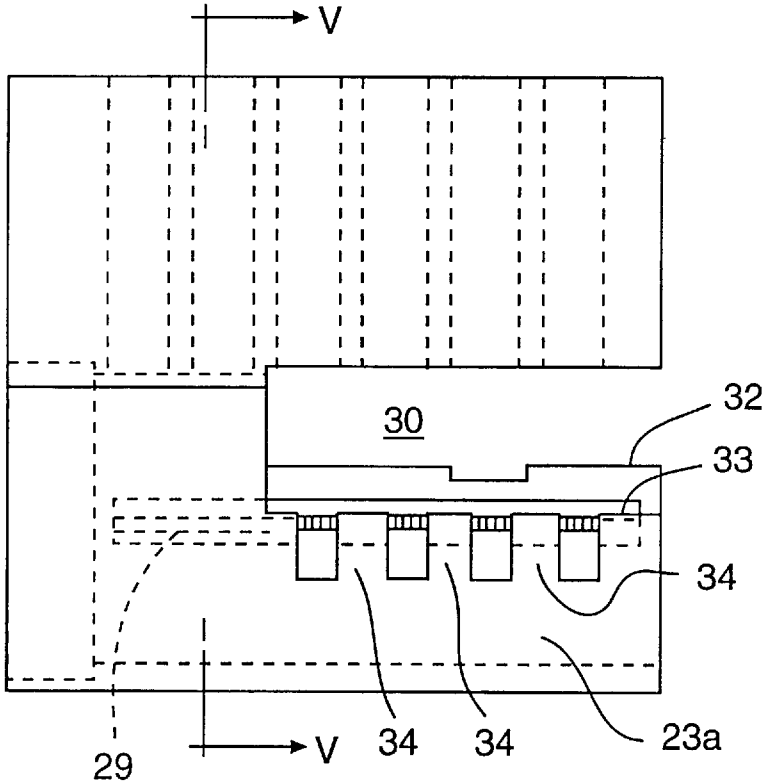
FIG. 3 is a side view of the core body shown in FIGS. 1 and 2.

In the exploded view of FIG. 2, the various parts of the removable cylinder lock core 20 are readily apparent.

The core body 21 (compare also FIGS. 3, 4, 5 and 6) comprises an upper, massive part 22 and a lower part 23 defining a cylindrical bore 24 extending axially therethrough. In the central vertical plane of the upper part 22, there is a row 25 of six holes 25*a*, 25*b*, 25*c*, 25*d*, 25*e* and 25*f* for accommodating upper portions 26 of locking tumblers, which are biassed in a conventional manner by associated helical springs 27. The rotatable key plug 60 has a corresponding row 65 of holes 65*a*, 65*b*, 65*c*, 65*d*, 65*e* and 65*f* which are in registry with the corresponding holes 25*a*–25*f* in a locking position. Lower portions 66 of the locking tumblers are located in the holes 65*a* through 65*f*. The retainer member 40, which is somewhat shorter in its axial length, has a corresponding row 55 of four holes 55*c*, 55*d*, 55*e* and 55*f*, likewise in registry with the corresponding holes in the rows 25 and 65.

In the rotatable key plug 60 there is also a row 67 of side tumblers, e.g. six such side tumblers, located in corresponding cavities inside the key plug 60 so as to be elevationally movable in a vertical plane B in parallel and slightly displaced sideways in relation to the vertical plane A through the key slot 68 and the row 65 of holes for the tumblers. As is known per se, the side tumblers are specifically elevated by a proper key 99 and cooperate with a side bar 80, which is located in a longitudinal groove 69 in the cylindrical outer surface of the rotatable key plug 60. In its locking position, the side bar 80 projects transversely outwardly and engages with a corresponding longitudinal recess 29 in the lower part 23 of the lock core 20. When all side tumblers 67 are properly elevated, the side bar 80 can be forced sideways into the groove 69 while letting projections 81 be fitted into corresponding recesses 70 in the lateral surface of each side tumbler 67. Such an operation of a side bar between a locking position and a releasing position is previously known per se, e.g. from WO 94/01643 (Widen).

In accordance with the present invention, the retainer member 40 has a special structure permitting the associated core body 21 to include a continuous lower wall portion 23*a*, which extends axially along the whole length of the cylindrical bore 24. Along an axial length, which corresponds to the axial length of the retainer member 40, the lower part 23 of the core body 21 is partially cut away, as appears from FIGS. 2, 3, 4 and 6, so as to form a chamber 30 accommodating the retainer member 40. The cut-away portion extends from the rear end of the core body 21 and has a circumferential extension of about 180° and is upwardly extended into the upper massive part 22 of the core body 21. Here, the accommodating chamber 30 is defined by a concave cylindrical surface 31, which adjoins an axially limited recess 39 dimensioned to receive the radially projecting locking lug 50 of the retainer member At one side (to the left in FIG. 6) of the continuous bottom wall portion 23*a*, the wall portion extends upwardly to form a longitudinal edge surface 32 located vertically above the central axis C of the cylindrical bore 24. The longitudinal edge surface 32 constitutes an abutment surface, which defines a first position of the retainer member locking the lock core 20 in its axially inserted position.

At the other side (to the right in FIG. 6), the continuous lower wall portion 23*a* has a longitudinal edge surface 33 with separated teeth portions 34 approximately at the level of the central axis C. Compare FIG. 3. The edge surface 33 constitutes abutment surface portions defining a second position of the retainer member, in which the projecting lug 50 is totally accommodated in the upper recess 32 so as to enable axial retraction of the lock core 20 as a unit.

The retainer member 40 comprises a base portion 41, which is formed substantially as a part-cylindrical shell with external and internal cylindrical surfaces 42 and 43, respectively, the locking lug 50 projecting radially outwardly from the base portion 41.

At one side (to the left in FIG. 7), the part-cylindrical base portion 41 has a substantially straight longitudinal edge 44, which abuts the longitudinal edge 32 in the first position of the retainer member 40. At the other side (to the right in FIG. 7), the part-cylindrical base portion 41 has a longitudinal edge 45 with downwardly projecting fingers 46 fitting between the teeth 34 at the longitudinal edge 33. When the retainer member is located in its second position, the edge portions 45 abut the surface portions 33.

The upper, external cylindrical surface 42 corresponds to the curvature of the concave cylindrical surface 31 in the upper, massive part 22 of the core body 21. Therefore, the retainer member is rotatable between its first and second positions while keeping a sliding contact between the cylindrical surfaces 42 and 31. Moreover, throughout such a rotational movement, the inner cylindrical surface 43 of the retainer member will define a wall portion of the cylindrical bore 24 as a supplement to the inside surface of the continuous lower wall portion 23*a* of the core body 21.

The circumferential dimensions of the continuous wall portion 23*a* and the base portion 41 of the retainer member 40 are such that the retainer member 40 can be rotated between its first and second positions through such an angle that the locking lug 50 is moved from a first locking position (compare FIG. 8) into a second, releasing position (compare FIG. 9) where it is totally accommodated in the recess 39.

Figure 7:
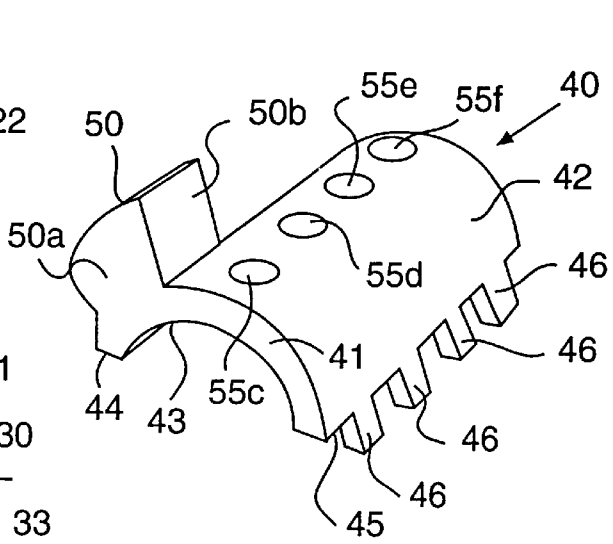
FIG. 7 is a perspective view of the retainer member shown from the other side in FIG. 2.
Figure 6:
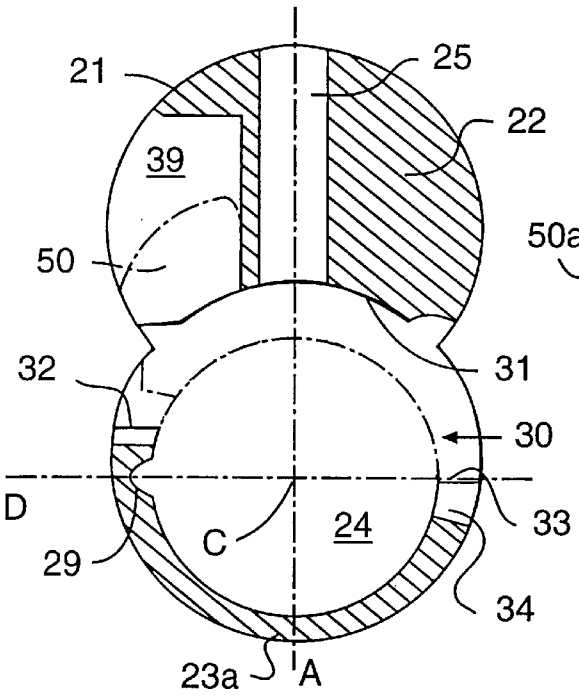
FIG. 6 is a cross-sectional view taken along line VI—VI in FIG. 4.
Figure 5:
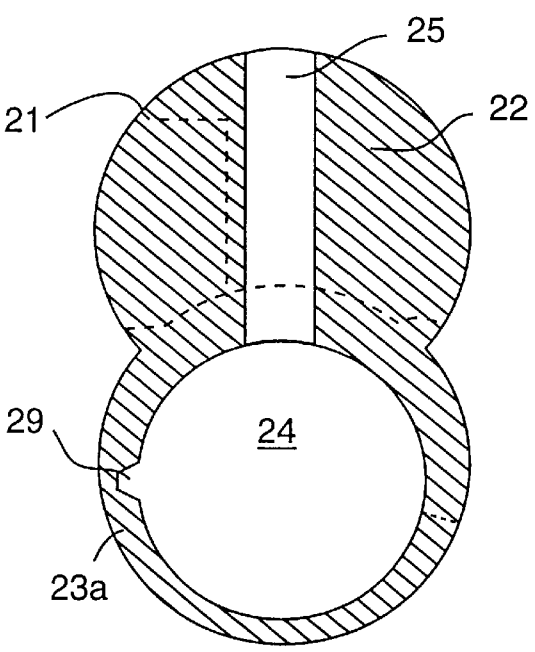
FIG. 5 is a cross-sectional view taken along line V—V in FIG. 3.

In the illustrated embodiment, as appears from FIG. 7, the projecting lug 50 is formed like a wing, and it has large opposite surface portions 50*a*, 50*b* (compare FIG. 7) which may contact corresponding surface portions of the recess 39 in the core body 21 and of the recess 14 in the casing 10, respectively, when the retainer member 40 is rotated into its first, locking position. During the rotary motion, the fingers 46 and the teeth 34 overlap each other circumferentially.

The recess 29 (or separate recess portions) for engaging the side bar 80 is formed entirely in the inside surface of the continuous lower wall portion 23*a*. This is made possible by the fact that the wall portion 23*a* extends axially along substantially the whole length of the cylindrical bore 24 in the region corresponding to the normal position of the outwardly projecting side bar 80. In the illustrated example, the side bar 80 is normally located at the same level as the central axis C and, therefore, the continuous lower wall portion 23*a* as a whole is inclined in relation to a transversal plane D, which is perpendicular to the vertical plane A through the central axis C (defining the cylindrical bore 24) and the row 25 of holes in the upper massive part 22 of the core body 21.

The operation of the lock will appear from FIGS. 8 through 11. By using a control key 99*c*, the side tumblers 67 and the tumbler pin portions 66 and 26 are raised to such positions that the upper ends of the lower tumbler pin portions 66 are all located in the shear line between the cylindrical surfaces 31 and 42, whereby the key plug 60 together with the retainer member 40 may be rotated into the position shown in FIG. 9. Then, the locking lug 50 is accommodated in the recess 39, so that the lock core 20 can be retracted axially as a unit from the casing 10 (provided that all tumblers are properly aligned).

Figures 8, 9, 10, 11:
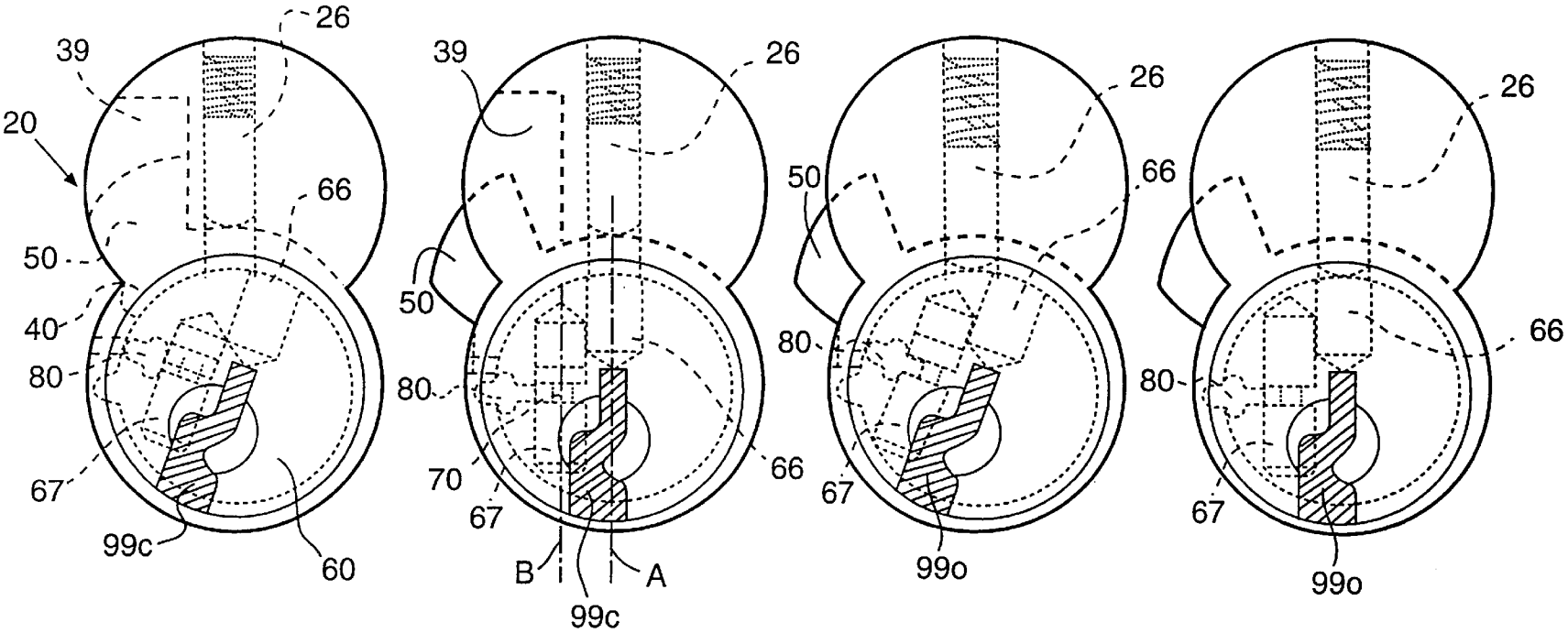
FIG. 8 is an end view of the lock core, illustrating the movement of the retainer member into its second, releasing position.
FIG. 9 is an end view of the lock core, illustrating the movement of the retainer member into its second, releasing position.
FIG. 10 is an end view illustrating the normal operation of the cylinder lock.
FIG. 11 is an end view illustrating the normal operation of the cylinder lock.

FIGS. 10 and 11 illustrate the normal operation of the lock by means of an operating key 99*o*. Then, the lower tumbler pin portions 66 are raised only to the shear line corresponding to the inner surface 43 of the retainer member 40. Thus, the retainer member will be maintained in its first position, where it positively locks the lock core 20 in its axially inserted position. The upper locking tumbler pin portions 26, which extend through the holes 25*c*, 25*d*, 25*e* and 25*f* as well as the holes 55*c*, 55*d*, 55*e* and 55*f* (FIG. 2), prevent the retainer member from rotation. Thus, only the key plug 60 can be rotated by means of a proper operating key.

The removable cylinder lock described above may be modified by those skilled in the art within the scope of the appended claims.

In the illustrated embodiment, the accommodating chamber 30 is cut out from one axial end of the lock core 20. This will facilitate the machining of the chamber walls and the mounting of the retainer member 40. However, alternatively, the accommodating chamber may be confined to a mid-section of the lock core 20. It is advantageous that the retainer member 40 has a substantial axial length, preferably about half of the axial length of the cylindrical bore 24, or even more. Then, many holes (normally three or four) can be provided in the retainer member in a row, whereby the latter is securely and accurately held in position by the tumblers.

The locking lug of the retainer member 40 may alternatively be shaped as a tangential (and possibly slightly radial as well) projection, especially in case the motion of the retainer member is not strictly rotational, but at least partly translatory.

The recess 29 for engaging the side bar does not necessarily have to be longitudinal and continuous. Instead, it may be constituted by a number of separate recess portions in a row. Also, naturally, there may be two side bars in the key plug and corresponding recesses in the continuous lower wall portion.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A removable core cylinder lock, comprising:

a cylinder lock casing having an axially extending cavity;

a removable cylinder lock core which is axially insertable into said cavity, said lock core having an upper massive part with a row of holes for accommodating locking tumblers and a lower part defining a cylindrical bore extending axially therethrough;

a cylindrical, rotatable key plug located in said cylindrical bore and having a longitudinal key slot for receiving a key cooperating with said locking tumblers; and a retainer member being transversely movable between a first position, in which the retainer member positively locks said lock core in an axially inserted position, and a second position, in which said lock core may be retracted, said retainer member having a transversely extending locking lug engaging with said casing when said retainer member is in said first position; wherein said lower part defining the cylindrical bore of the cylinder lock core is partially cut away so as to form an axially extending chamber accommodating said transversely movable retainer member and leaving a continuous lower wall portion, which partially encloses the rotatable key plug and extends axially along substantially the whole length of said cylindrical bore, said retainer member has a limited circumferential extension, which is substantially supplementary to said continuous lower wall portion so as to define said cylindrical bore, said accommodating chamber is upwardly extended into said upper massive part of the cylinder lock core, said retainer member comprises a base portion, which is formed substantially as a part-cylindrical shell with external and internal cylindrical surfaces, and a radially outwardly projecting portion constituting said locking lug, said accommodating chamber is upwardly defined by a concave cylindrical surface, the retainer member has a corresponding upper convex cylindrical surface, said retainer member being rotatable between said first and second positions with a sliding contact between said concave and convex surfaces, the circumferential dimension of said base portion is less than the circumferential dimension of said accommodating chamber, and said base portion and said lower wall portion have longitudinal abutment surface portions defining said first and second positions of the retainer member.

2. The removable core cylinder lock as defined in claim 1, wherein said abutment surface portions are formed on circumferentially overlapping but longitudinally displaced edge portions of said retainer member and said lower wall portion, respectively.

3. The removable core cylinder lock as defined in claim 1, wherein the retainer member has a convex curved upper surface which engages a correspondingly curved inner surface of the lock core, said convex curved upper surface having a row of apertures formed therein, and wherein the locking lug protrudes from said convex curved upper surface of the retainer member and rises above said row of apertures.

4. The removable core cylinder lock as defined in claim 1, wherein said retainer member is a part-circular arcuate member extending for less than a complete circle.

5. The removable core cylinder lock as defined in claim 1, wherein the axially extending chamber includes a first portion and a second portion, with the first portion open at a first axial end of said lock core and having a first height, and the second portion having a second height greater than said first height.

6. A removable core cylinder lock, comprising:

a cylinder lock casing having an axially extending cavity;

a removable cylinder lock core which is axially insertable into said cavity, said lock core having an upper massive part with a row of holes for accommodating locking tumblers and a lower part defining a cylindrical bore extending axially therethrough;

a cylindrical, rotatable key plug located in said cylindrical bore and having a longitudinal key slot for receiving a key cooperating with said locking tumblers; and a retainer member being transversely movable between a first position, in which the retainer member positively locks said lock core in an axially inserted position, and a second position, in which said lock core may be retracted, said retainer member having a transversely extending locking lug projecting radially outwardly from said retainer member and engaging with said casing when said retainer member is in said first position; wherein said lower part defining the cylindrical bore of the cylinder lock core is partially cut away so as to form an axially extending chamber accommodating said transversely movable retainer member and leaving a continuous lower wall portion, which partially encloses the rotatable key plug and extends axially along substantially the whole length of said cylindrical bore, said retainer member has a limited circumferential extension, which is substantially supplementary to said continuous lower wall portion so as to define said cylindrical bore, and said accommodating chamber is cut out from one axial end of the lock core and is upwardly extended into said upper massive part of the cylinder lock core so as to form an axially limited recess dimensioned to receive said locking lug which projects radially outwardly from said retainer member, said key plug having a side bar, said side bar being movable between a releasing position within a groove in a cylindrical outer surface of the rotatable key plug, and a locking position engaging a recess adjoining said cylindrical bore of the lock core, wherein said recess for engaging said side bar is formed entirely in an inside surface of said continuous lower wall portion, said continuous lower wall portion of the lower part of said lock core has a circumferential extension of about 180°, and said continuous lower wall portion is inclined in relation to a transversal plane which is perpendicular to a plane through said row of locking tumblers in said massive part of the lock core, said recess for engaging said side bar being located substantially at the same level as the rotational axis of said rotatable key plug.

7. The removable core cylinder lock as defined in claim 6, wherein the retainer member has a convex curved upper surface which engages a correspondingly curved inner surface of the lock core, said convex curved upper surface having a row of apertures formed therein, and wherein the locking lug protrudes from said convex curved upper surface of the retainer member and rises above said row of apertures.

8. The removable core cylinder lock as defined in claim 6, wherein the axially extending chamber includes a first portion and a second portion, with the first portion open at a first axial end of said lock core and having a first height, and the second portion having a second height greater than said first height.

9. The removable core cylinder lock as defined in claim 6, wherein said retainer member is a part-circular arcuate member extending for less than a complete circle.

10. A removable core cylinder lock, comprising:

a cylinder lock casing having an axially extending cavity;

a removable cylinder lock core which is axially insertable into said cavity, said lock core having an upper massive part with a row of holes for accommodating locking tumblers and a lower part defining a cylindrical bore extending axially therethrough;

a cylindrical, rotatable key plug located in said cylindrical bore and having a longitudinal key slot for receiving a key co-operating with said locking tumblers;

an axially elongated retainer member being transversely movable between a first position, in which the retainer member positively locks said lock core in an axially inserted position, and a second position, in which said lock core may be retracted, said retainer member having a base portion and a transversely extending locking lug formed as a wing projecting radially outwardly from said base portion and engaging with said casing when said retainer member is in said first position, the retainer member including an upper surface which engages an inner surface of the lock core;

said lower part defining the cylindrical bore of the cylinder lock core being partially cut away so as to form an axially extending chamber accommodating said transversely movable retainer member and leaving a continuous lower wall portion, which partially encloses the rotatable key plug and extends axially along substantially the whole length of said cylindrical bore;

said retainer member having a limited circumferential extension, which is substantially supplementary to said continuous lower wall portion so as to define said cylindrical bore; and said accommodating chamber including a first portion cut out from one axial end of the lock core and open at said one axial end of the lock core, and a second portion upwardly extended into an adjoining axially limited recess formed in said upper massive part of the cylinder lock core between opposite surface portions of said upper massive part and at a distance from said one axial end of said lock core, said recess being dimensioned to receive said locking lug, said wing having large surface portions corresponding to said opposite surface portions of said upper massive part, said wing being totally accommodated in said recess when said retainer member is in said second position such that axial movement of said retainer member in either direction is limited by engagement of said large surface portions of said wing with said opposite surface portions of said upper massive part.

11. The removable core cylinder lock as defined in claim 10, wherein the first portion of the accommodating chamber has a first height, and the second portion has a second height greater than said first height.

12. The removable core cylinder lock as defined in claim 10, wherein the convex curved upper surface of the retainer member includes a row of apertures therein, and the locking lug protrudes radially from said convex curved upper surface of the retainer member and rises above said row of apertures.

13. The removable core cylinder lock as defined in claim 10, wherein said retainer member is a part-circular arcuate member extending for less than a complete circle.

14. The removable core cylinder lock as defined in claim 10, wherein the upper surface of the retainer member comprises a convex curved upper surface, and said inner surface of the lock core comprises a correspondingly curved inner surface.

15. The removable core cylinder lock as defined in claim 10, wherein said retainer member has an axial length, which corresponds to at least half the axial length of said row of holes in said upper massive part.

16. The removable core cylinder lock as defined in claim 10, wherein said wing is projected transversely outwardly into engagement with said casing when the retainer member is moved into said first position.

17. The removable core cylinder lock as defined in claim 16, wherein said large surface portions make contact with corresponding ones of said opposite surface portions of the upper massive part of the lock core when the retainer member is located in said first position.

18. The removable core cylinder lock as defined in claim 10, wherein the retainer member is a part-circular arcuate member extending for less than a complete circle having a convex curved outer surface, said convex curved outer surface having a row of apertures formed therein, wherein the locking lug protrudes radially from said convex curved outer surface of the retainer member and rises above said row of apertures, and wherein the axially extending chamber includes a first portion and a second portion, with the first portion open at a first axial end of said lock core and having a first height, and the second portion having a second height greater than said first height.

19. The removable core cylinder lock as defined in claim 10, wherein a circumferential periphery of said rotatable key plug slidingly contacts an inner surface of said cylindrical bore during rotation of said key plug in said cylindrical bore.

20. A removable core cylinder lock, comprising:

a cylinder lock casing having an axially extending cavity;

a removable cylinder lock core which is axially insertable into said cavity, said lock core having an upper massive part with a row of holes for accommodating locking tumblers and a lower part defining a cylindrical bore extending axially therethrough;

a cylindrical, rotatable key plug located in said cylindrical bore and having a longitudinal key slot for receiving a key co-operating with said locking tumblers; and an axially elongated retainer member being transversely movable between a first position, in which the retainer member positively locks said lock core in an axially inserted position, and a second position, in which said lock core may be retracted, said retainer member having a base portion and a transversely extending locking lug formed as a wing projecting radially outwardly from said base portion and engaging with said casing when said retainer member is in said first position; wherein said lower part defining the cylindrical bore of the cylinder lock core is partially cut away so as to form an axially extending chamber accommodating said transversely movable retainer member and leaving a continuous lower wall portion, which partially encloses the rotatable key plug and extends axially along substantially the whole length of said cylindrical bore;

said retainer member has a limited circumferential extension, which is substantially supplementary to said continuous lower wall portion so as to define said cylindrical bore, and said accommodating chamber is cut out from one axial end of the lock core and is upwardly extended into an adjoining recess in said upper massive part of the cylinder lock core, said recess being axially limited between opposite surface portions of said upper massive part and being dimensioned to receive said locking lug, said base portion of said retainer member being located in said accommodating chamber, said wing having large surface portions corresponding to said opposite surface portions of said upper massive part, said wing being totally accommodated in said recess when said retainer member is in said second position, wherein the retainer member is a part-circular arcuate member extending for less than a complete circle having a convex curved outer surface, an upper portion of which engages a correspondingly curved inner surface of the lock core, said convex curved outer surface having a row of apertures formed therein, wherein the locking lug protrudes from said convex curved outer surface of the retainer member and rises above said upper portion of said convex curved outer surface, and wherein the axially extending chamber includes a first portion and a second portion, with the first portion open at a first axial end of said lock core and having a first height, and the second portion having a second height greater than said first height.

* * * * *

UNITED STATES PATENT AND TRADEMARK OFFICE

CERTIFICATE OF CORRECTION

PATENT NO. : 5,813,260

DATED : Sep. 29, 1998

INVENTOR(S) : Widén

It is certified that error appears in the above-indentified patent and that said Letters Patent is hereby corrected as shown below:

On the title page, item "[73] Assignee", please change "Winloc AG, Zug, Sweden" to – Winloc AG, Zug, Switzerland --.

Signed and Sealed this

Ninth Day of November, 1999

*Attest:*

*Attesting Officer*

Q. TODD DICKINSON

*Acting Commissioner of Patents and Trademarks*